US008012265B2

(12) United States Patent
Mendenhall et al.

(10) Patent No.: US 8,012,265 B2
(45) **Date of Patent: *Sep. 6, 2011**

(54) CONCRETE/ASPHALT WET WASHING SYSTEM

(75) Inventors: Robert L. Mendenhall, Las Vegas, NV (US); Gilbert Cabrera, Las Vegas, NV (US)

(73) Assignee: The Mendenhall Family Trust, Las Vegas, NV (US)

( * ) Notice: Subject to any disclaimer, the term of this patent is extended or adjusted under 35 U.S.C. 154(b) by 158 days.

This patent is subject to a terminal disclaimer.

(21) Appl. No.: 12/433,567

(22) Filed: Apr. 30, 2009

(65) Prior Publication Data

US 2011/0139177 A1 Jun. 16, 2011

Related U.S. Application Data

(63) Continuation of application No. 11/685,597, filed on Mar. 13, 2007, now Pat. No. 7,527,699, which is a continuation-in-part of application No. 11/377,975, filed on Mar. 16, 2006, now Pat. No. 7,578,885.

(51) Int. Cl.
*B08B 3/02* (2006.01)
*A47L 7/00* (2006.01)

(52) U.S. Cl. ..... 134/6; 134/34; 134/104.1; 134/172; 134/182

(58) Field of Classification Search ..... 134/6, 10, 134/34, 104.1, 172, 182; 15/320, 322, 345, 15/348

See application file for complete search history.

(56) References Cited

U.S. PATENT DOCUMENTS

| | | | | |
|---|---|---|---|---|
| 2,782,435 | A | 2/1957 | Stone | |
| 2,917,761 | A | 12/1959 | Burgdorff | |
| 3,151,348 | A * | 10/1964 | Maasberg | 15/320 |
| 3,802,022 | A | 4/1974 | Fleming | |
| 4,018,483 | A | 4/1977 | Smith | |
| 4,092,249 | A | 5/1978 | La Gatta | |
| 4,168,562 | A | 9/1979 | Maasberg | |
| 4,398,551 | A * | 8/1983 | Moorehead | 134/104.4 |
| 4,457,044 | A | 7/1984 | Erdman et al. | |
| 4,561,145 | A | 12/1985 | Latham | |
| 4,754,521 | A | 7/1988 | Zoni | |
| 4,993,498 | A | 2/1991 | Fresnel | |
| 5,006,012 | A | 4/1991 | Sterner | |
| 5,902,414 | A | 5/1999 | Keal et al. | |
| 5,976,268 | A * | 11/1999 | Eliason et al. | 134/10 |
| 6,142,290 | A | 11/2000 | Tagliaferri | |
| 6,154,922 | A | 12/2000 | Vanderlinden | |
| 6,444,046 | B1 | 9/2002 | Hillbrand | |
| 7,255,116 | B2 | 8/2007 | Crocker | |
| 7,527,699 | B2 * | 5/2009 | Mendenhall | 134/34 |
| 7,578,885 | B2 * | 8/2009 | Mendenhall et al. | 134/6 |
| 2003/0204931 | A1 | 11/2003 | Kim | |

* cited by examiner

*Primary Examiner* — Michael Barr
*Assistant Examiner* — Saeed T Chaudhry
(74) *Attorney, Agent, or Firm* — Greenberg Traurig

(57) ABSTRACT

A surface cleaning system having a storage container, debris collection apparatus and debris conduit is disclosed. Water discharged from spray nozzles configured in a circular arrangement forces debris into a debris collection ring and then a debris conduit. An auger, water pressure or air pressure is used to force the debris through debris conduit into the storage container for disposal. The design of the debris collection apparatus also facilitates the capture of most of the water used to force the debris into the debris collection apparatus. Accordingly, the system is able to reuse the water thereby extending the surface area that may be cleaned with a specified amount of water.

12 Claims, 14 Drawing Sheets

CONCRETE/ASPHALT WET WASHING SYSTEM

CROSS-REFERENCE TO RELATED APPLICATION

This application is a continuation of application Ser. No. 11/685,597 filed on Mar. 13, 2007, now U.S. Pat. No. 7,527,699 which is a continuation-in-part of application Ser. No. 11/377,975 filed on Mar. 16, 2006, now U.S. Pat. No. 7,578,885 both of which are incorporated herein by reference in their entirety for all purposes.

FIELD OF THE INVENTION

The embodiments of the present invention relate to a mobile device for cleaning road and street surfaces, more particularly, the embodiments relate to a mobile, all water configuration, street sweeper and cleaning system and method of using the same.

BACKGROUND

Vehicles configured with street or road cleaning systems are well-known in the prior art. The systems commonly utilize combinations of brushes and water to collect debris and clean a subject road surface. Unfortunately, the prior art systems suffer from drawbacks, including inefficient operation, large water consumption, complex configurations and ineffective results. Often times the prior art systems simply use brushes which tend to move debris from one location to another without collecting the debris and leave large, hazardous pools of water. Additionally, the current systems cause dust to be disseminated throughout a wide area surrounding the cleaning system.

Even though the current street sweeper systems suffer from the aforementioned drawbacks, there is a tremendous need for such sweepers. Accidental and intentional litter, dust from construction projects, landscape remnants and similar debris commonly finds its way onto roads or streets. When on streets, these materials are unsightly and can create a hazard for drivers. In addition, construction sites and the like must abide by environmental regulations requiring a clean work site.

Thus, there is a need for a street sweeper that overcomes the drawbacks of the prior-art street sweepers.

SUMMARY

Accordingly, a first embodiment of the present invention discloses a surface cleaning system comprising: a storage system; a collection ring coupled to the storage system via a debris conduit extending generally from the collection ring to the storage system; and a water pump operable to draw water from the storage system and discharge the water through one or more spray nozzles adjacent to, and directed into, the collection ring wherein the discharged water forces debris and water into the collection ring. The surface cleaning system further includes a collection tray positioned within the collection ring and extending to an opening of the debris conduit and a trash pump positioned within the debris conduit for forcing debris and water from the collection ring and collection tray into the debris conduit.

In a second embodiment, the surface cleaning system further includes one or more spray nozzles and/or air spray nozzles positioned along a length of the debris conduit for forcing debris and water through the debris conduit and into the storage system and a clarifier tank having a mesh screen positioned within the storage system for separating debris from water to produce substantially clean water.

A third embodiment of the present invention discloses a method of cleaning a road or street surface comprising: projecting water against a road surface such that debris is collected into a collection ring; forcing debris and water from the collection ring along a debris conduit using a trash pump; and collecting debris and water from the debris conduit into a storage container. The method further includes directing debris, water and other heavy particles into the collection ring using one or more adjustable screens adjacent the collection ring and separating debris from water using a clarifier tank having a mesh screen to produce substantially clean water.

The street sweeper system of the present invention utilizes high velocity water or air streams to collect and, in some embodiments transport, debris to a storage container or tank. Other embodiments utilize an auger to transport debris to a storage container. In one embodiment, the tank includes two compartments into which the debris and water is collected. As described in more detail below, the compartments are each partially open to one another allowing water and debris to separate and collect into respective compartments.

Other variations, embodiments and features of the present invention will become evident from the following detailed description, drawings and claims.

DETAILED DESCRIPTION

Figure 1:
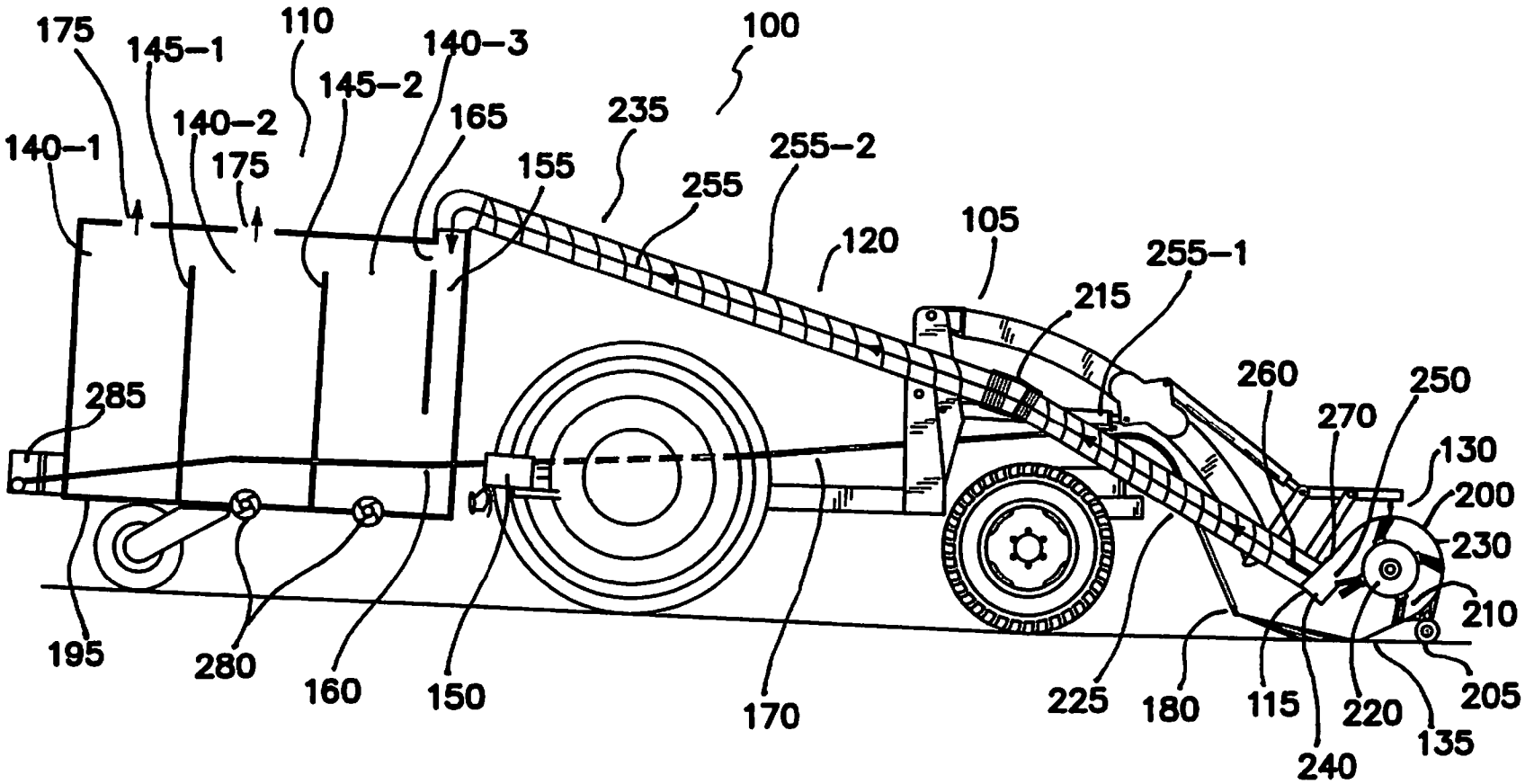
FIG. 1 illustrates a side view of an embodiment of the present invention installed on a tractor.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended.

Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Reference is now made to the figures wherein like parts are referred to by like numerals throughout. FIG. 1 shows a side view of one embodiment of the present invention wherein the street sweeper system is generally referred to by reference numeral 100. The street sweeper system 100 incorporates three primary components, namely a liquid and debris storage tank 110, debris conduit 120 and debris collection apparatus 130.

The cross-sectional view of the liquid and debris storage tank 110 shows three individual compartments 140-1 through 140-3 partially separated by barriers 145-1 and 145-2. Upper sections of the compartments 140-1 through 140-3 are open to one another. Initially, prior to use, generally clean water or any desired liquid is pumped or otherwise deposited into compartments 140-1 through 140-3 and subsequently used to collect debris. As described in more detail below, compartments 140-2 and 140-3 function to retain debris and dirty water collected during use, while compartment 140-1 is designated for clean water.

Figure 5:
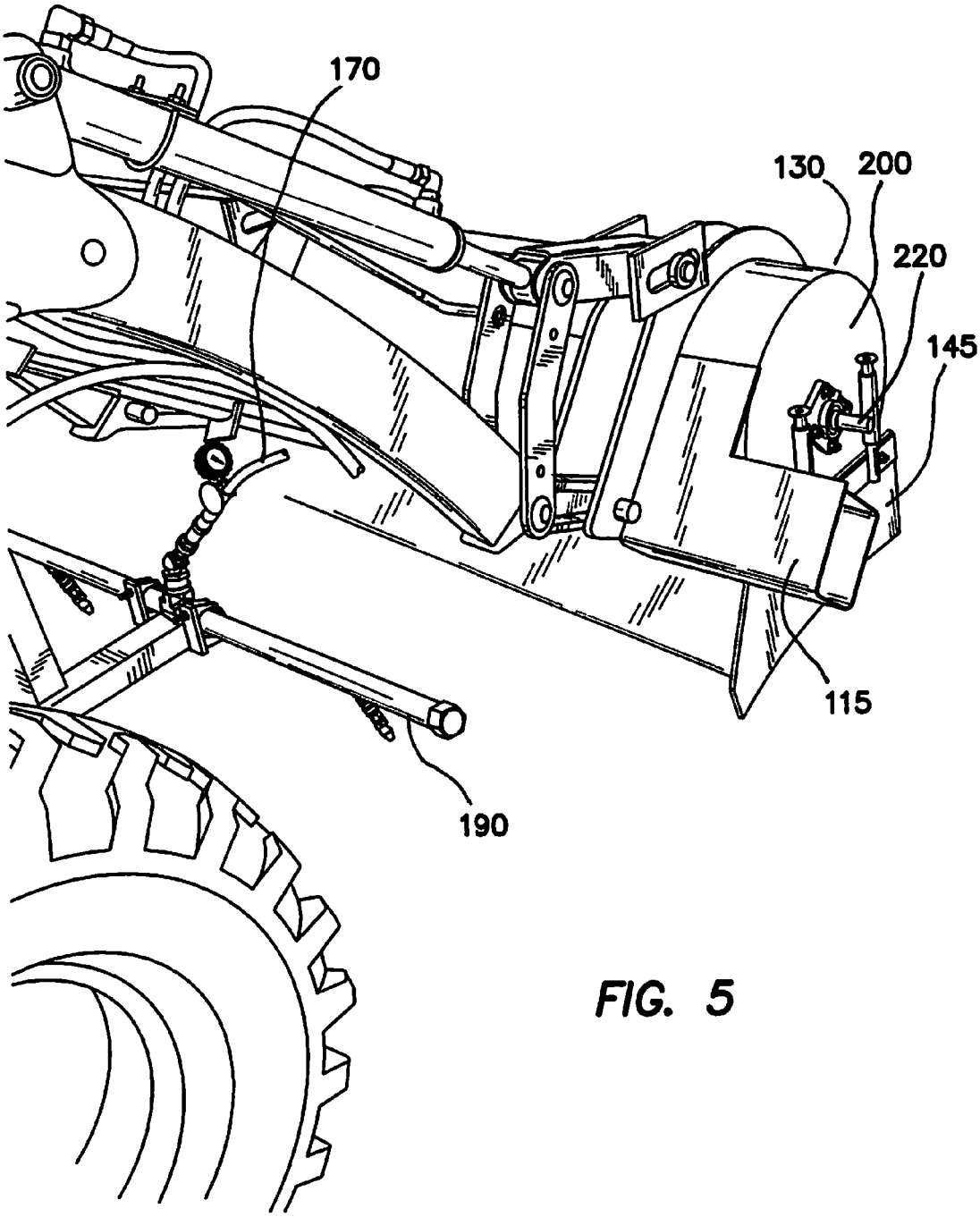
FIG. 5 illustrates a perspective rear view of the debris collection apparatus as arranged in combination with a series of spray nozzles.
Figure 6:
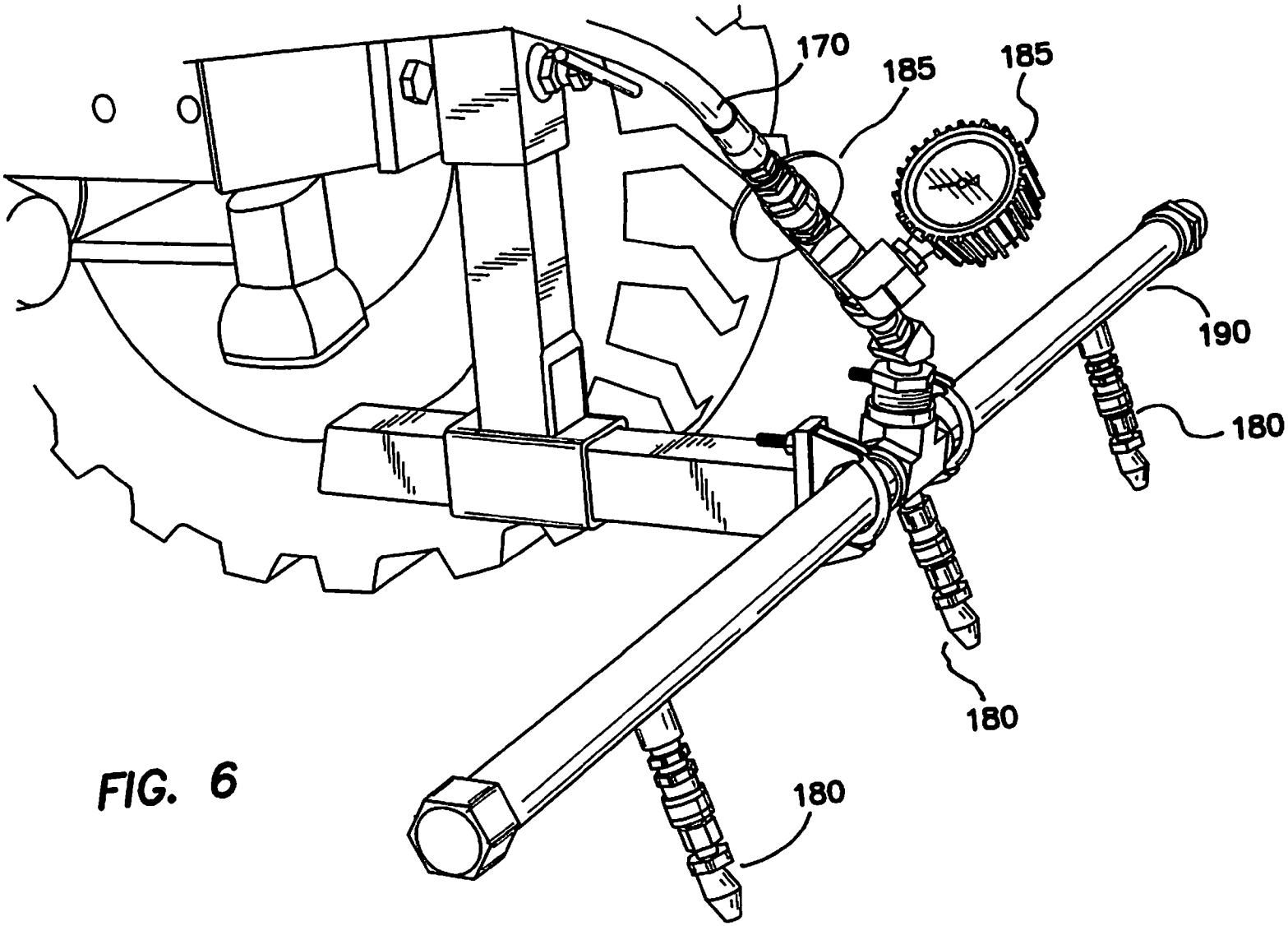
FIG. 6 illustrates the series of spray nozzles.
Figure 7:
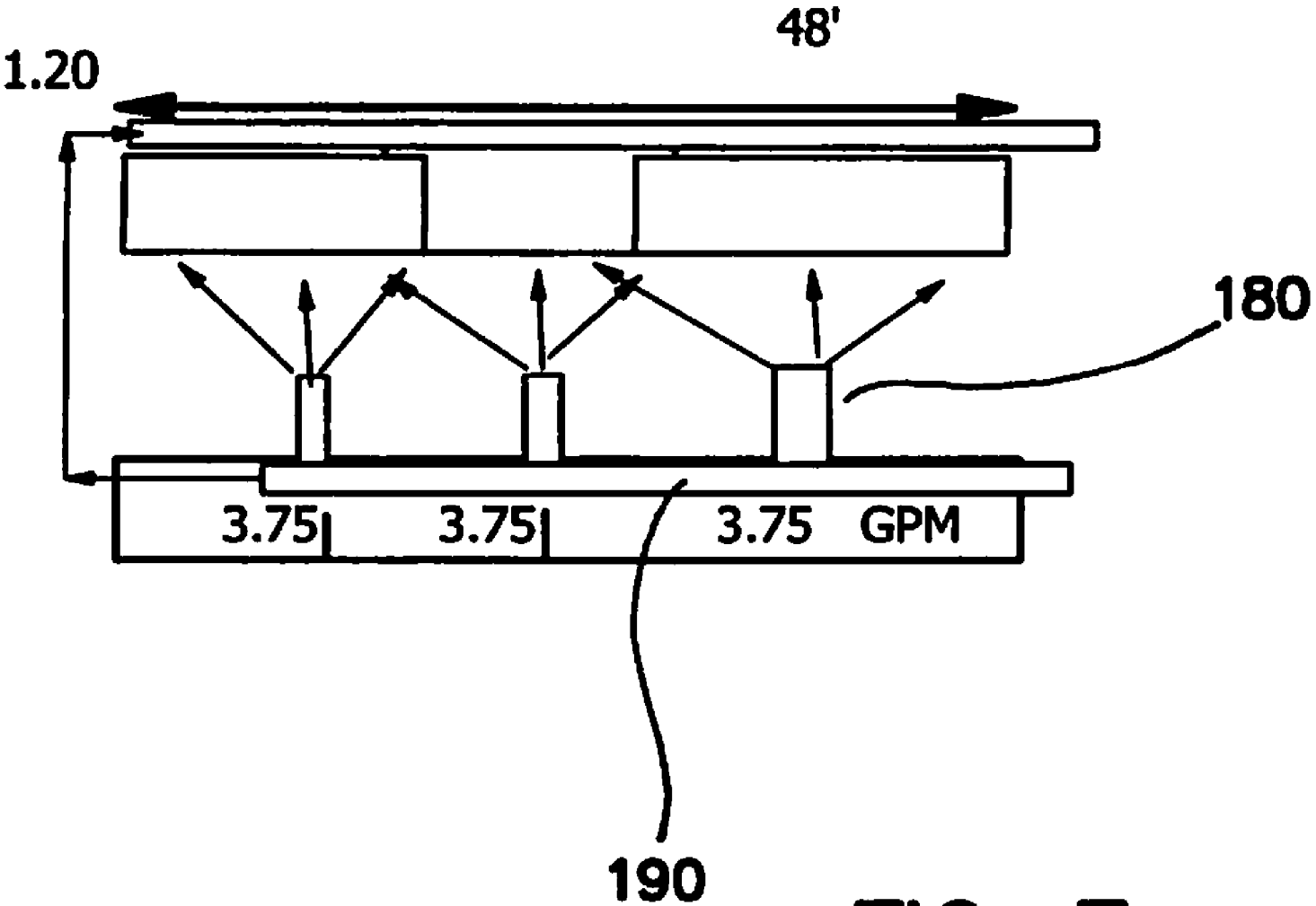
FIG. 7 illustrates a top block view of the arrangement between the spray nozzles and debris collection apparatus.

More particularly, during use, a water pump 150 draws water from compartments 140-1 through 140-3 via tube, pipe or hose 160 and forces the water through tube, pipe or hose 170. The water exits hose 170 through a series of nozzles 180 (only one nozzle is visible in FIG. 1) positioned near, and directed into, the debris collection apparatus 130. The nozzles 180 increase the velocity and resultant pressure applied by the water such that the water is able to force debris into the debris collection apparatus 130. As shown in FIGS. 5-7, the series of spray nozzles 180 are spaced horizontally along a spray tube 190 to create a sufficiently wide path of operation. Water pump 150 forces the water through hose 170 into tube 190 and ultimately through the spaced spray nozzles 180. The hose 170 is connected to the tube 190 near a mid-point to provide for even distribution of water flow through the spaced nozzles 180. In one example, three nozzles 180 are spaced horizontally so that the nozzles 180 operate over a four foot wide path. The number and spacing of nozzles 180 may be increased or decreased depending on the subject cleaning task and the size of the vehicle accommodating the street sweeper system 100. One or more pressure gauges 185 may also be used at various locations along the water hoses or tubes to allow operators to assess the need for increasing or decreasing the water pressure and/or identifying problems with the system. Connecting the nozzles 180 to the spray tube 190 can be accomplished using any number of conventional means, included threaded connectors and the like. The nozzle and spray tube combination may also be fabricated as a single unit.

As shown in FIGS. 1-4, the debris collection apparatus 130 comprises a housing 200 for containing and protecting a series of brushes 210 attached to a shaft 220. FIGS. 2-5 show the debris collection apparatus 130 with a side exit channel 115 for accommodating a first end of the debris conduit 120 (not shown in FIGS. 2-5) extending along a side of the vehicle. The housing 200 defines a large opening for capturing debris therein. A hydraulic, electric, gas-powered or similar power source (not shown) drives shaft 220 and attached brushes 210.

Optionally, the debris collection apparatus 130 may include a hinged scoop 135 that contacts the subject street surface during operation. Hinge 138 connects the scoop 135 to the housing 200. In the event the surface topography changes, the altitude of the hinged scoop 135 changes automatically (i.e., adjusts about hinge 138) thereby maintaining contact with the street surface. Optional side walls 145 affixed to the debris collection apparatus 130 direct debris and water into the debris collection apparatus 130. The side walls 145 may automatically adjust in a vertical position by means of slidable rods 125. In this manner, as the side walls 145 encounter deviations in the street or road, the side walls 145 are able to adjust accordingly.

Figure 1A:
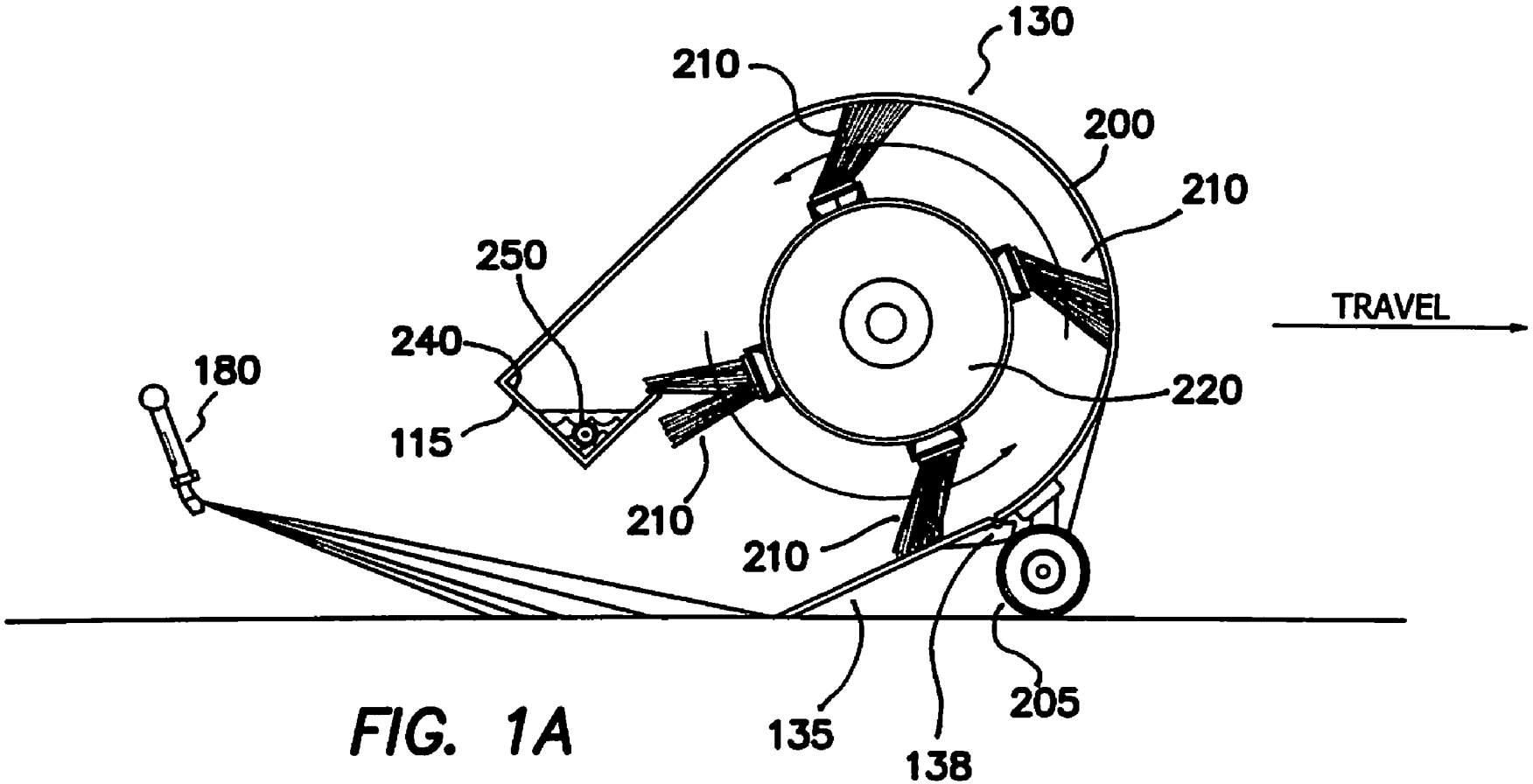
FIG. 1A illustrates a transparent, side view of a debris collection apparatus of the present invention.
Figure 2:
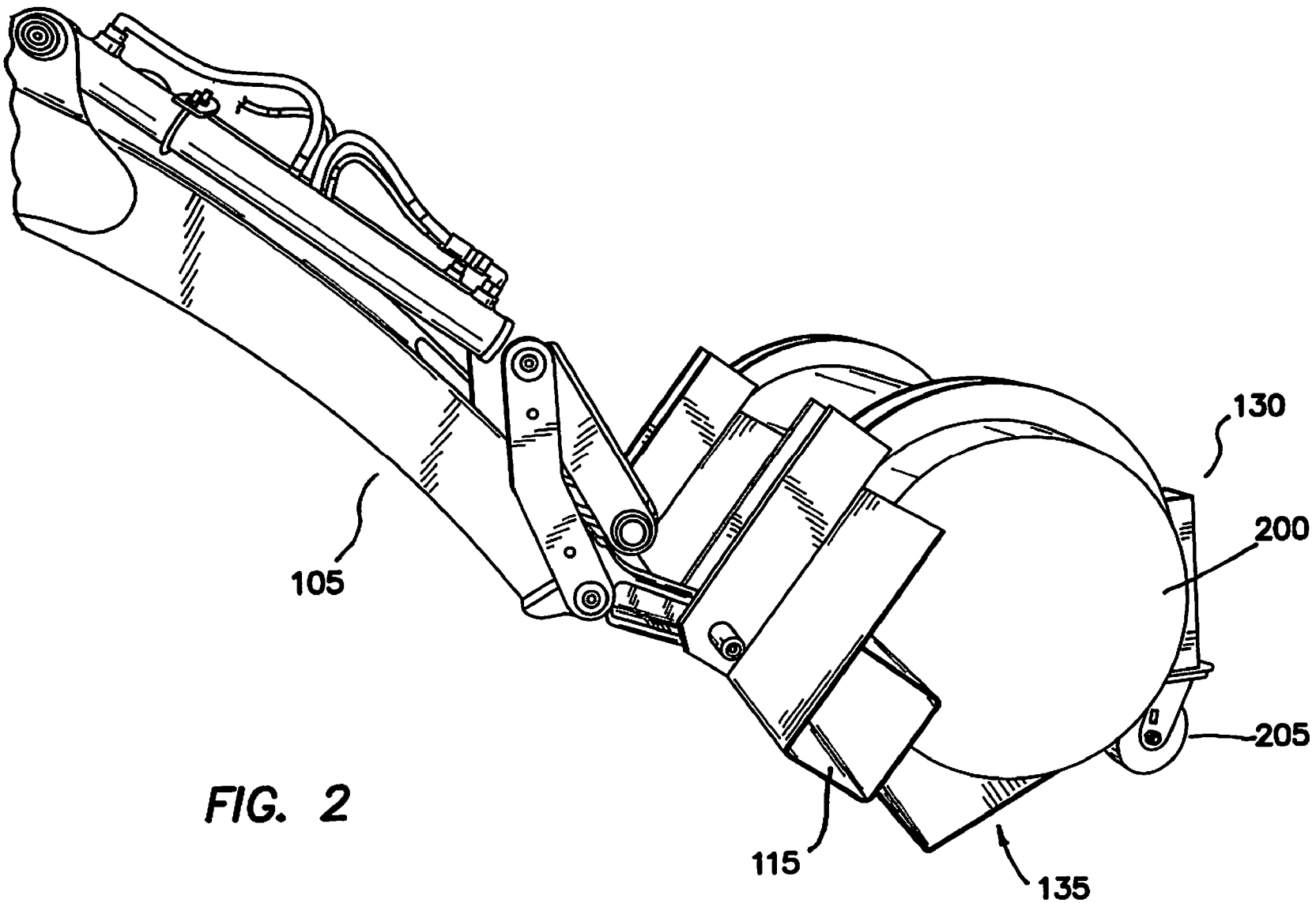
FIG. 2 illustrates a side view of a debris collection apparatus of the present invention.
Figure 3:
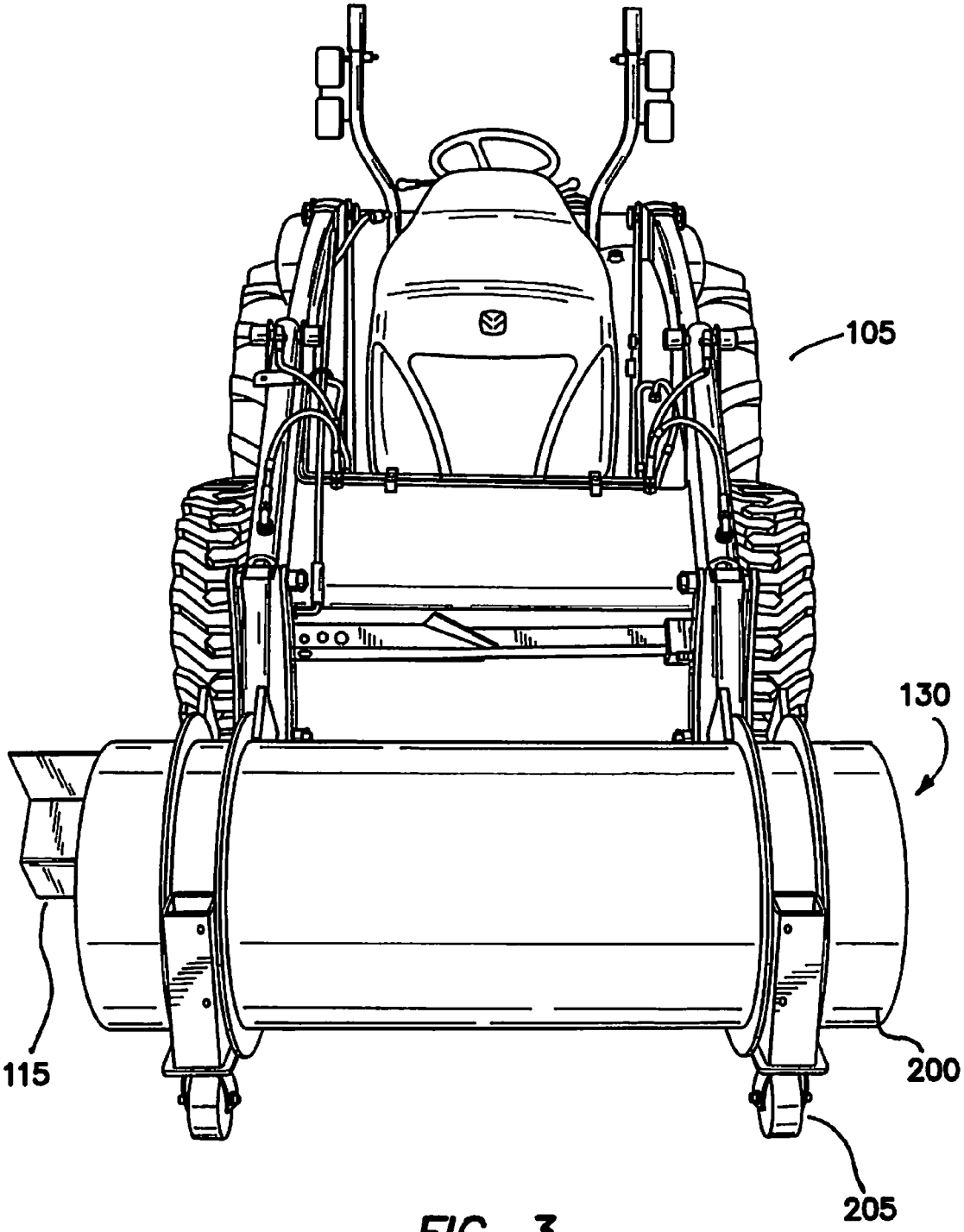
FIG. 3 illustrates a front view of the debris collection apparatus of the present invention.
Figure 4:
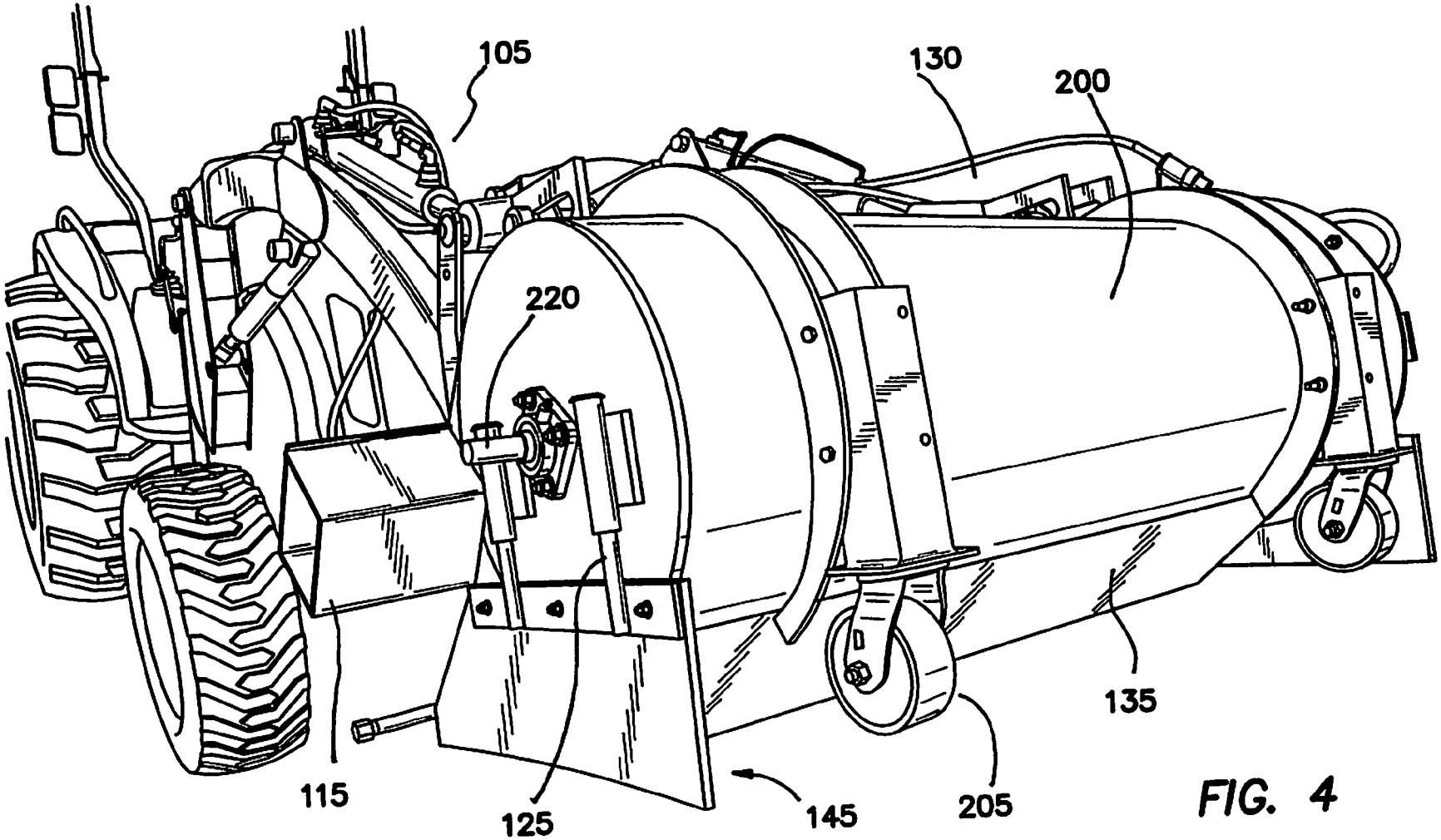
FIG. 4 illustrates perspective front view of the debris collection apparatus in a raised position.

During operation, as best seen in FIG. 1A, water exiting via spray nozzles 180 forces debris into the debris collection apparatus 130 and into the path of the rotating brushes 210. The brushes 210 rotate at approximately 40 to 50 RPM in the same direction as the water exiting nozzles 180 such that the brushes 210 propel the debris and collected water circumferentially through the housing 200 and into a discharge tray 240 extending along an internal width of the debris collection apparatus 130. As evident in FIGS. 1 and 1A, the brushes 210 do not make contact with the subject road or street surface during use but should make contact with an inner surface 230 of the housing 200. In this arrangement, unlike prior systems, the brushes do not agitate debris and dust on the road or street prior to collection. Moreover, the brush 210 contact with the inner surface 230 of the housing 200 maximizes the debris and water forced into the discharge tray 240. Ideally, the brushes 210 should have a length sufficient to contact the discharge tray 240 as they rotate. In this manner, collected debris and water is more likely than not to be collected in the discharge tray 240 and subsequently the debris conduit 120. The discharge tray 240 leads the debris and water to the exit channel 115 and into the debris conduit 120. One or more discharge nozzles 250 positioned horizontally within the housing 200, and adjacent and generally parallel to the discharge tray 240, discharge water (or air produced by a compressor) at high pressure to force the collected debris and water along the discharge tray 240 and toward an entrance 270 of the debris conduit 120.

In another embodiment, one or more high pressure orbital spray nozzles 260 positioned near the entrance 270 of the debris conduit 120 discharge water (or air) at high pressure forcing the debris through the debris conduit 120 and into the liquid and debris storage tank 110. Additional spray nozzles may be positioned intermittently along the length of the debris conduit 120 and directed to continuously force the debris along the debris conduit 120 and into the liquid and debris storage tank 110. Water pump 150 or additional water pumps (not shown) force water through pipes, tubes and hoses (not shown) to and through the nozzles 250 and 260.

The liquid and debris storage container 110 includes three partially separate compartments 140-1 through 140-3. Upper sections of the compartments 140-1 through 140-3 are open to one another. As described above, compartments 140-1 through 140-3 initially contain substantially clean water. Compartments 140-2 and 140-3 are configured to capture and retain contaminated water and debris, respectively. Collected debris and water exits the debris conduit 120 into compartment 140-3 through channel 155 that directs the debris and water near a bottom half of compartment 140-3. A vent 165 near an upper portion of channel 155 provides a passageway for water in the event debris and water block a lower portion of the channel 155. By discharging debris and water near a bottom half of compartment 140-3, the debris and smaller particulates are not overly agitated and smoothly flow into a flocculent that encourages the debris and particulates to settle at the bottom of the compartment 140-3. Collected water is retained in compartment 140-3 until the water rises to a level defined by barrier 145-2 separating compartment 140-3 from compartment 140-2. Once the level of the collected water reaches a top of the barrier 145-2 it flows over the barrier 145-2 and into compartment 140-2.

The collected water flowing into compartment 140-2 is ideally rid of larger debris and particulates, but likely remains dirty or contaminated. As additional water flows into compartment 140-2, debris and particulates settle on a bottom of the compartment 140-2. The water level in compartment 140-2 rises to a level whereby relatively clean water flows over barrier 145-1 and into compartment 140-1. Like compartment 140-1, compartment 140-2 may contain a flocculent to trap any additional debris and particulates not captured in compartment 140-3. The water that reaches compartment 140-1 is relatively free of debris and many of the original particulates. Accordingly, the water from compartment 140-1 is passed through a filter 285 (e.g., carbon or sand filter) and reused to collect debris from the subject surface. In this manner a large amount of the water may be used on several occasions during a cleaning operation.

The liquid and debris storage container 110 further includes a series of vents 175 integrated into an upper surface. The vents 175 are designed to release any gases which may accumulate in the liquid and debris storage container 110. Screw augers 280 are incorporated in, and extend across, a bottom surface 195 of compartments 140-2, 140-3. The augers 280 function to remove the settled debris and particulates from compartments 140-2, 140-3. Accessible openings (not shown) in compartments 140-2, 140-3 provide means for the debris and particulates to be transported by the augers 280 into a disposal unit, truck or similar device. One or more wheels 205 provide mobility to the storage container 110.

Figure 8:
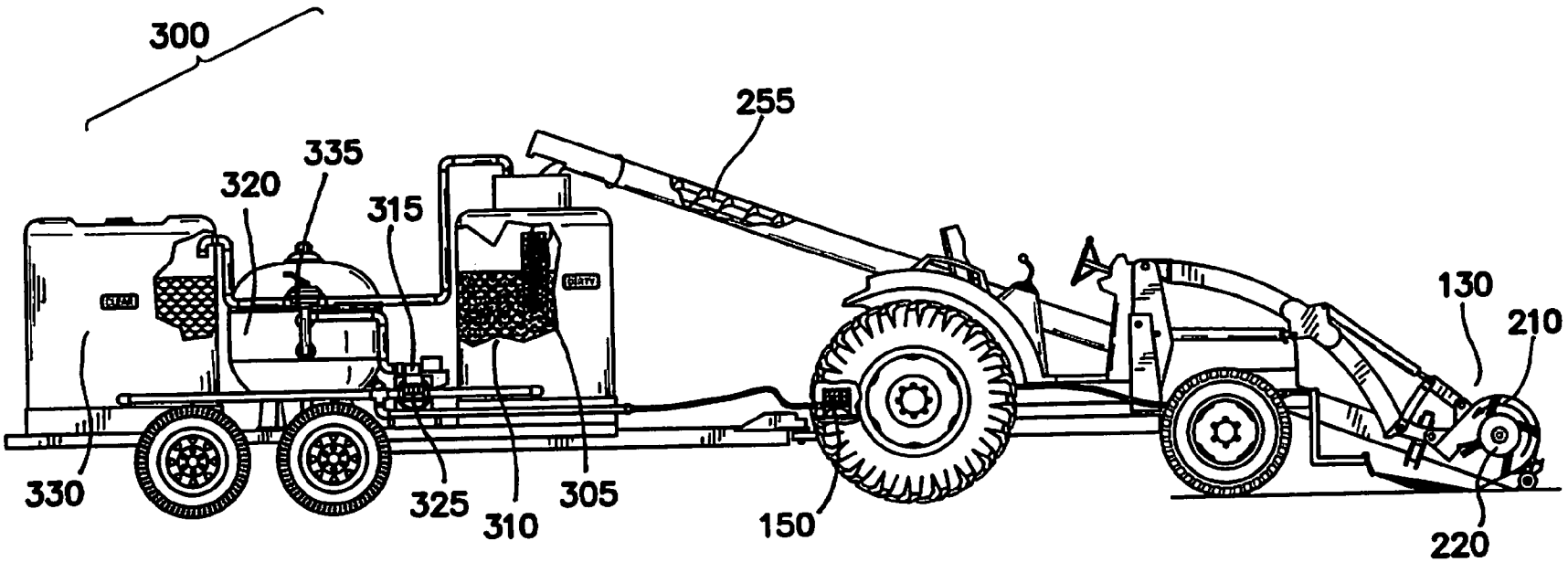
FIG. 8 illustrates another embodiment of the present invention utilizing an auger to transport debris and water from the debris collection apparatus to a storage container having independent units.
Figure 9A:
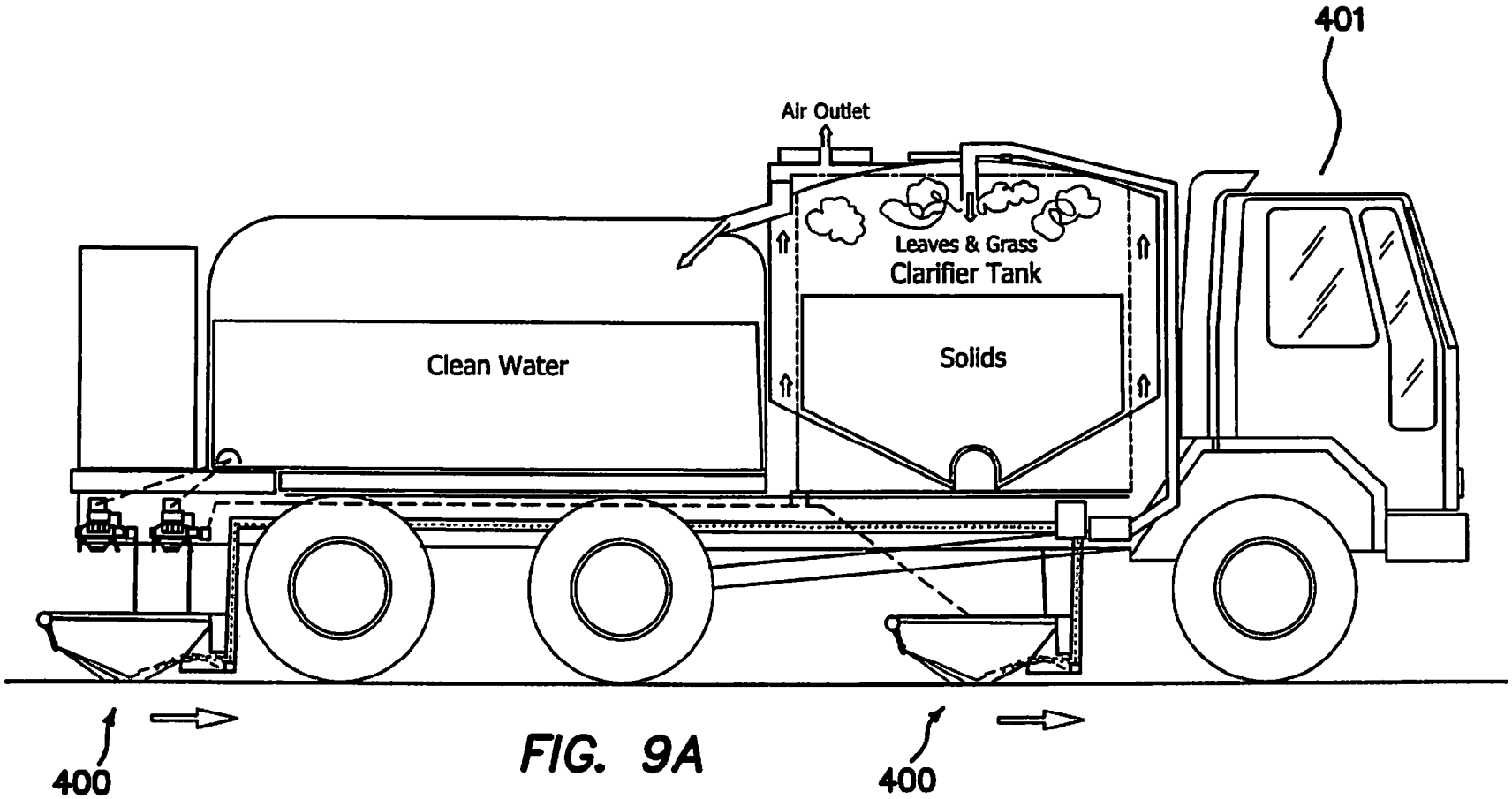
FIG. 9*a* illustrates a side view of a vehicle having a pair of brushless collection ring apparatuses of one embodiment of the present invention installed.
Figure 9B:
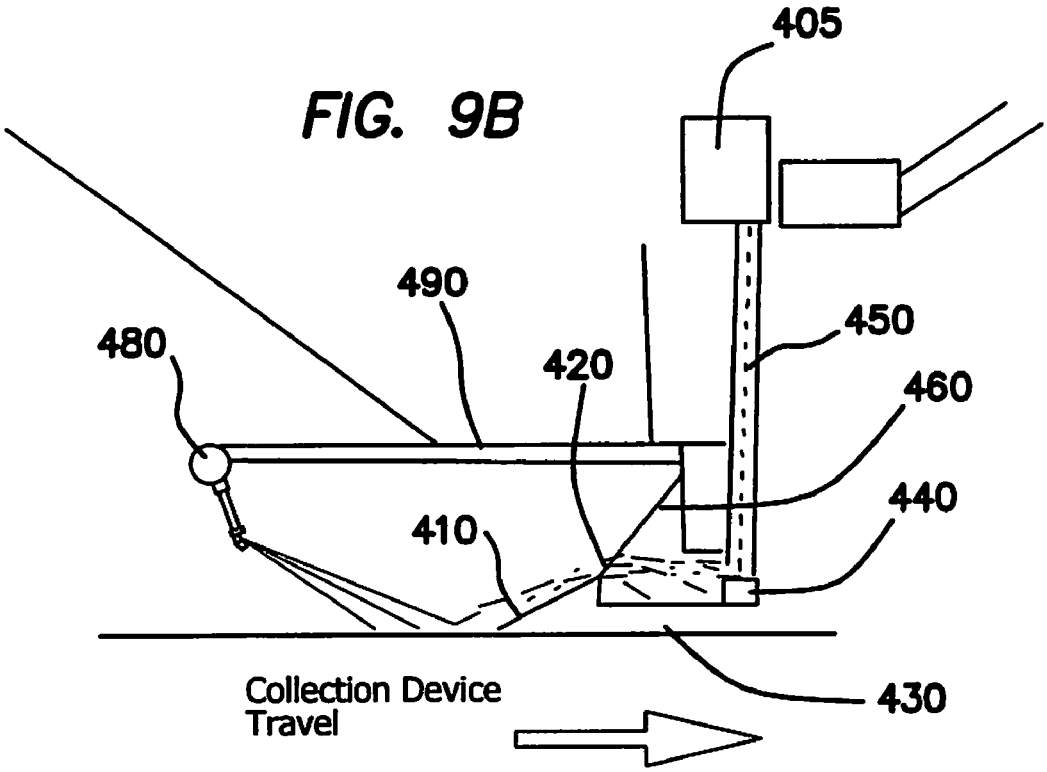
FIG. 9*b* illustrates a close up view of a brushless collection ring apparatus.
Figure 11:
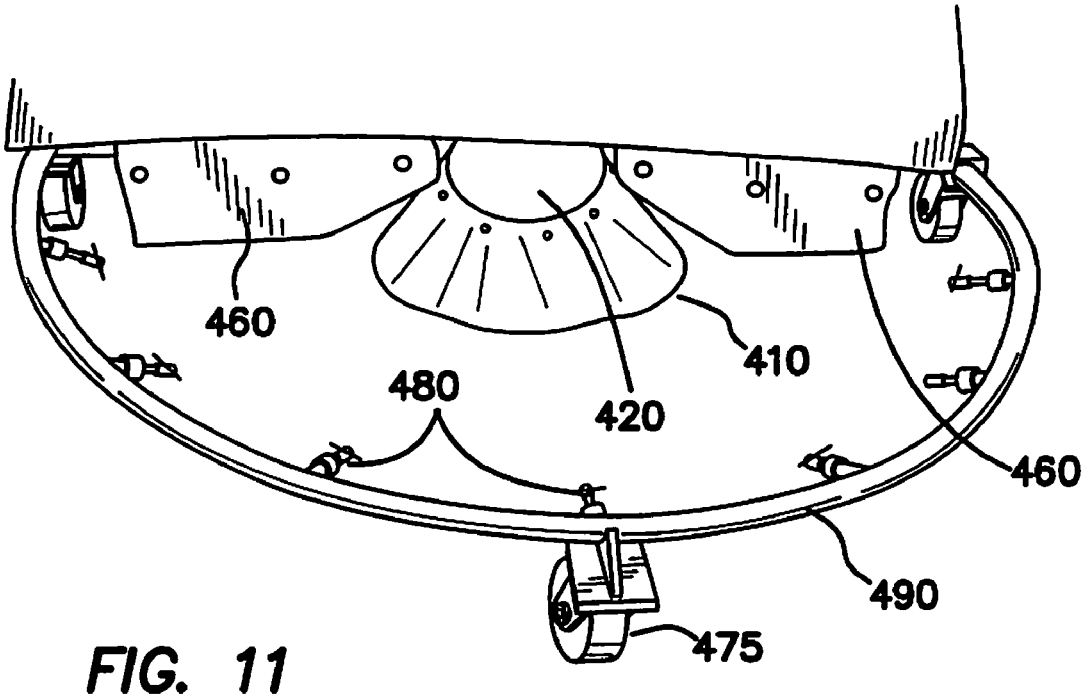
FIGS. 10-13 illustrate upper views of the brushless collection ring apparatus shown in FIG. 9.
Figure 10:
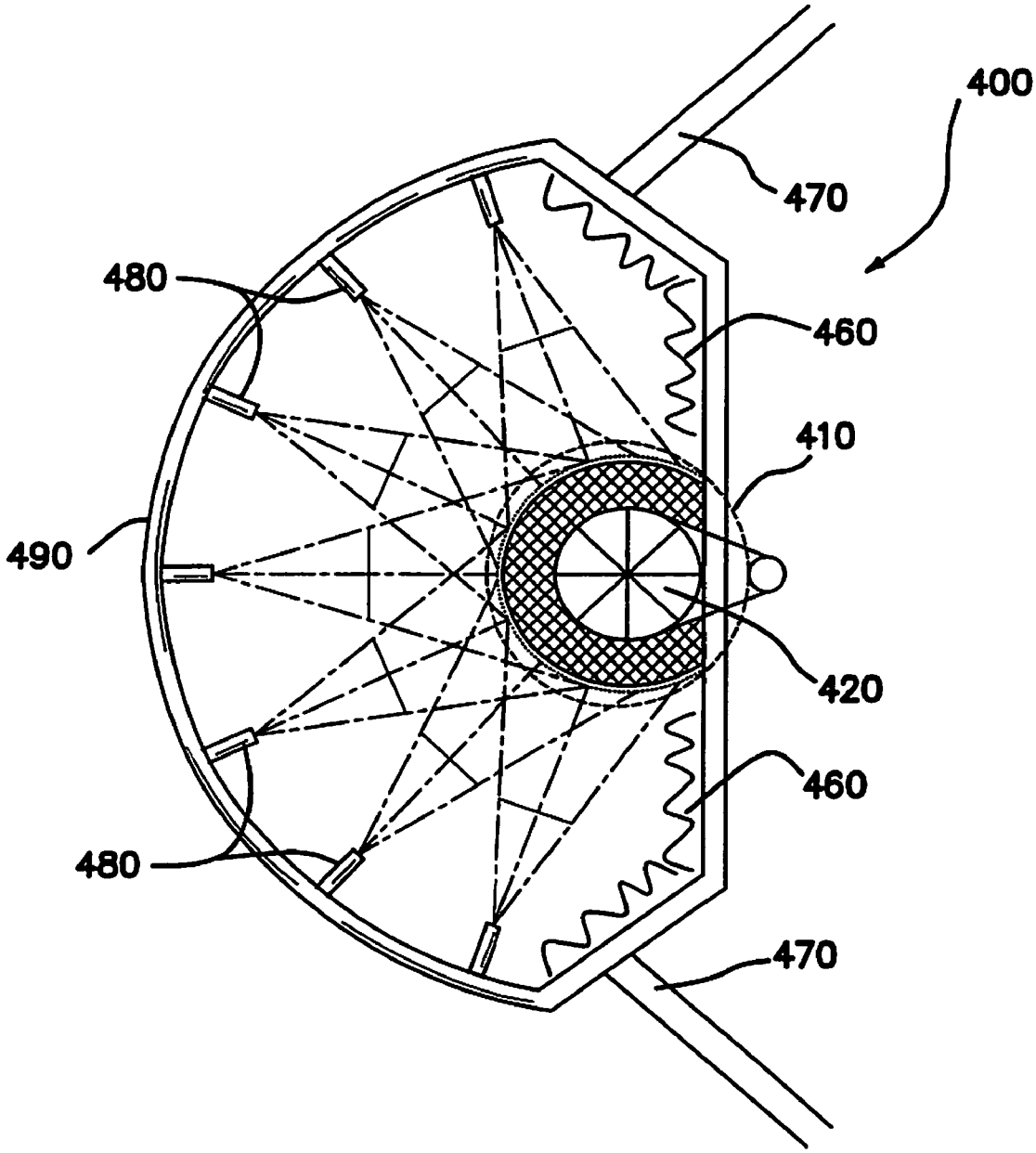
Figure 12:
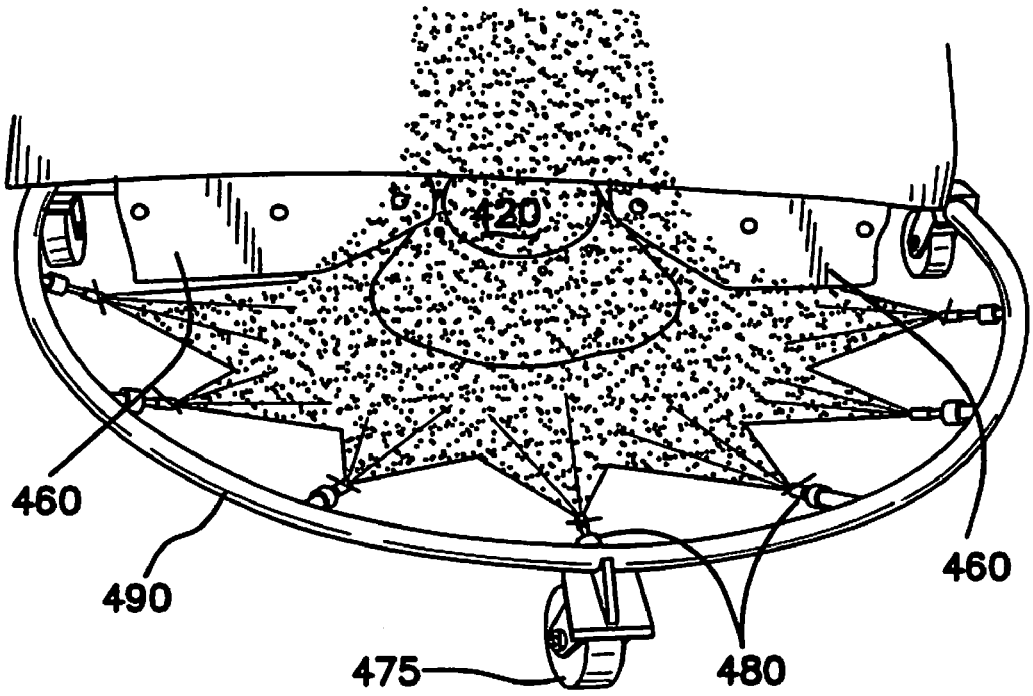
Figure 13:
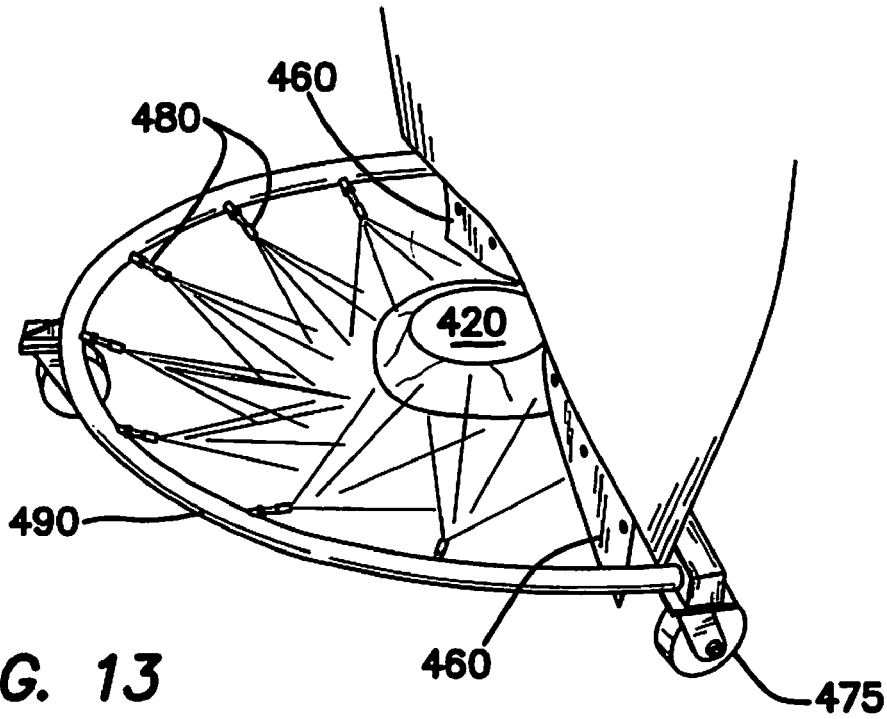

In another embodiment, as shown in FIG. 8, an auger 255 carries the debris and water from the debris collection apparatus 130 to a debris storage system 300. The auger 255 may be driven by the same power source (e.g., motor) driving the shaft 220 and attached brushes 210 or may rely on a separate power source. In one instance, the auger 255 is concealed in a tubular sleeve (not shown) that rotates with the auger 255. The tubular sleeve and auger 255 are then concealed with the debris conduit 120. The sleeve functions to maintain a path for the collected debris and water while ensuring the debris conduit 120 is not damaged by the auger 255.

FIG. 8 also shows an alternative water and debris storage system 300 comprising three independent and separate containers 310, 320 and 330. Container 310 receives the debris and water transported by auger 255. An intake filter 305 incorporated in container 310 catches large debris and release water and smaller debris. The dirty water from container 310 is pumped to the second container 320. Second container 320 is a sand filter that removes particulates from the dirty water. A Triton II sand filter is one example of a suitable sand filter. After passing through the sand filter 320, the clean water is pumped into container 330 and reused in the cleaning process. To facilitate the transfer of the water from container to container, the water and debris storage system 300 further incorporates an auxiliary pump 315, two-way valve 325 and back-flush valve 335.

As represented in the figures herein, the street sweeper system 100 is installed on a tractor 105. However, it will be understood by those skilled in the art that the street sweeper system 100 can be mounted on any suitable vehicle. Installing the street sweeper system 100 on a suitable vehicle is accomplished using conventional type connection means. Regardless of the type of transport vehicle, the vehicle operator may operate the street sweeper system 100 from a driver position in a closed or open vehicle cabin. A control panel (not shown) includes an on-off switch that causes the street sweeper system 100 to operate substantially as described herein. Operational parameters related to the water pumps, nozzles, collection apparatus brushes and augers may be individually controlled by the vehicle operator. The vehicle operator also controls the vertical position of the debris collection apparatus 130. During operation, the scoop 135 and defined opening of the debris collection apparatus 130 should be against the subject surface as near thereto as possible to ensure a maximum amount of debris and water is collected into the housing 200 of the debris collection apparatus 130. During non-operation, the debris collection apparatus 130 is maintained in an elevated position. With a tractor, the debris collection apparatus 130 is lifted akin to a conventional tractor scoop. A flexible hinge 215 integrated in the debris conduit 120 permits a lower portion 225 of the debris conduit 120 to move independently of an upper portion 235. A similar debris conduit 120 design may be used with a truck or other suitable vehicle. To accommodate the flexible hinge 215 in the debris conduit 120, the auger 255 may be formed of two separate members; a first member 215-1 in the lower portion 225 of the debris conduit 120 and a second member 215-2 in the upper portion 235 of the debris conduit 120.

The street sweeper system 100 of the embodiments of the present invention provide a thorough cleaning of a subject street or road surface while dramatically reducing the amount of consumed water. One embodiment of the present invention, having a four foot long spray tube 190, supporting three spray nozzles 180, is capable of cleaning a 60,000 square foot surface with 975 gallons of water. During the cleaning operation, only 97.5 gallons of water (i.e., 10% of the total water amount used) are lost such that 877 gallons are recovered during the operation. The recovered water can then be reused as described herein. Accordingly, a much larger area can be cleaned using a fixed amount of water.

Reference is now made to FIGS. 9-13 illustrating one or more brushless collection ring apparatuses 400 for collecting debris similar to the debris collection apparatus 130. FIG. 9*a* shows a forward and rearward pair of brushless collection ring apparatuses 400 in place on a vehicle 401. The brushless collection ring apparatus 400 includes a plurality of nozzles 480 (only one nozzle is visible in FIGS. 9*a* and 9*b*) positioned near, and directed into, an opening 420 of a collection ring 410. Like above, water from the nozzles 480, due to increased velocity and resultant pressure, is able to force debris into the opening 420 of the collection ring 410 as best illustrated in FIGS. 10-13. In addition, an auxiliary power unit for a hydraulic system (not shown) may be used to pump high pressure water to the spray nozzles 480. In one embodiment, the water is pressurized to 160 psi and up 60 gallons per minute is forced through the nozzles 480. Ideally, the collection ring 410 is shaped as an upside-down funnel and is fabricated of a metal alloy. However, the collection ring 410 can be fabricated of any suitable material and can be designed in various shapes and sizes to facilitate the collection of debris and water. Although the collection ring 410 appears to contact the subject street surface, it is appreciated that hinges and other hydraulics (not shown) may be incorporated in the apparatus 400 to facilitate surface topography changes related to road surface conditions. A flocculation pump 405 may also be positioned adjacent to the collection ring apparatuses 410.

As best shown in FIGS. 10-13, the series of spray nozzles 480 can be spaced horizontally along a semi-circular spray tube 490 to create a sufficiently enclosed area of operation. The semi-circular spray tube 490 may provide added advantage over that of the elongated spray tube 190 in that any debris or sprayed water is circumferentially contained within the enclosure outlined by the semi-circular spray tube 490 thereby further maximizing the amount of consumed water that can be reclaimed. In addition, a plurality of adjustable screens 460 similar to the side walls 145 described above may be disposed about the semi-circular spray tube 490 to further facilitate the collection of debris, water and other heavy particles on the road. Ideally, the adjustable screen 460 is similar to a vehicle's splash guard or splash flap and functions to keep debris and water contained within the area defined by the semi-circular spray tube 490. The semi-circular spray tube may be supported by one or more wheels 475.

During operation, a water pump (not shown) forces water through two hoses 470 into the semi-circular tube 490 and ultimately through the spaced spray nozzles 480. Water exiting via spray nozzles 480 forces debris into the collection ring 410. The two hoses 470 can be connected to the semi-circular tube 490 on opposite ends in order to provide for even distribution of water flow through the spaced nozzles 480. Although two hoses 470 are shown, there can be more of fewer hoses 470 depending on the shape and configuration of the semi-circular spray tube 490. Furthermore, the number and spacing of nozzles 480 may be increased or decreased depending on the subject cleaning task and the size of the vehicle accommodating the street sweeper system 100. Likewise, the nozzles 480 can be connected to the semi-circular tube 490 using conventional means, or alternatively, they can be fabricated as a single unit.

As the debris and water enter the opening 420 of the collection ring 410, they are gathered by a collection tray 430 within the collection ring 410. The collection tray 430 leads the collected debris and water to an opening of a debris conduit 450. Ideally, the collection tray 430 leads the debris and water to the debris conduit 450 based on its sloping configuration and/or by sheer accumulation of debris and water. In the alternative, the collection process may be facilitated by the use of a trash pump 440, which forces the collected debris and water from the collection tray 430 into the debris conduit 450. Instead of a trash pump 440, any hydraulically-driven pump can also be used. Any collected debris and water within the debris conduit 450 can subsequently be continuously forced toward a liquid and debris storage tank (not shown) via a plurality of discharge nozzles (or air produced by a compressor (not shown)) positioned intermittently along the length of the debris conduit 450 as previously described. Water pumps or additional hydraulic pumps may also be incorporated.

Figure 14:
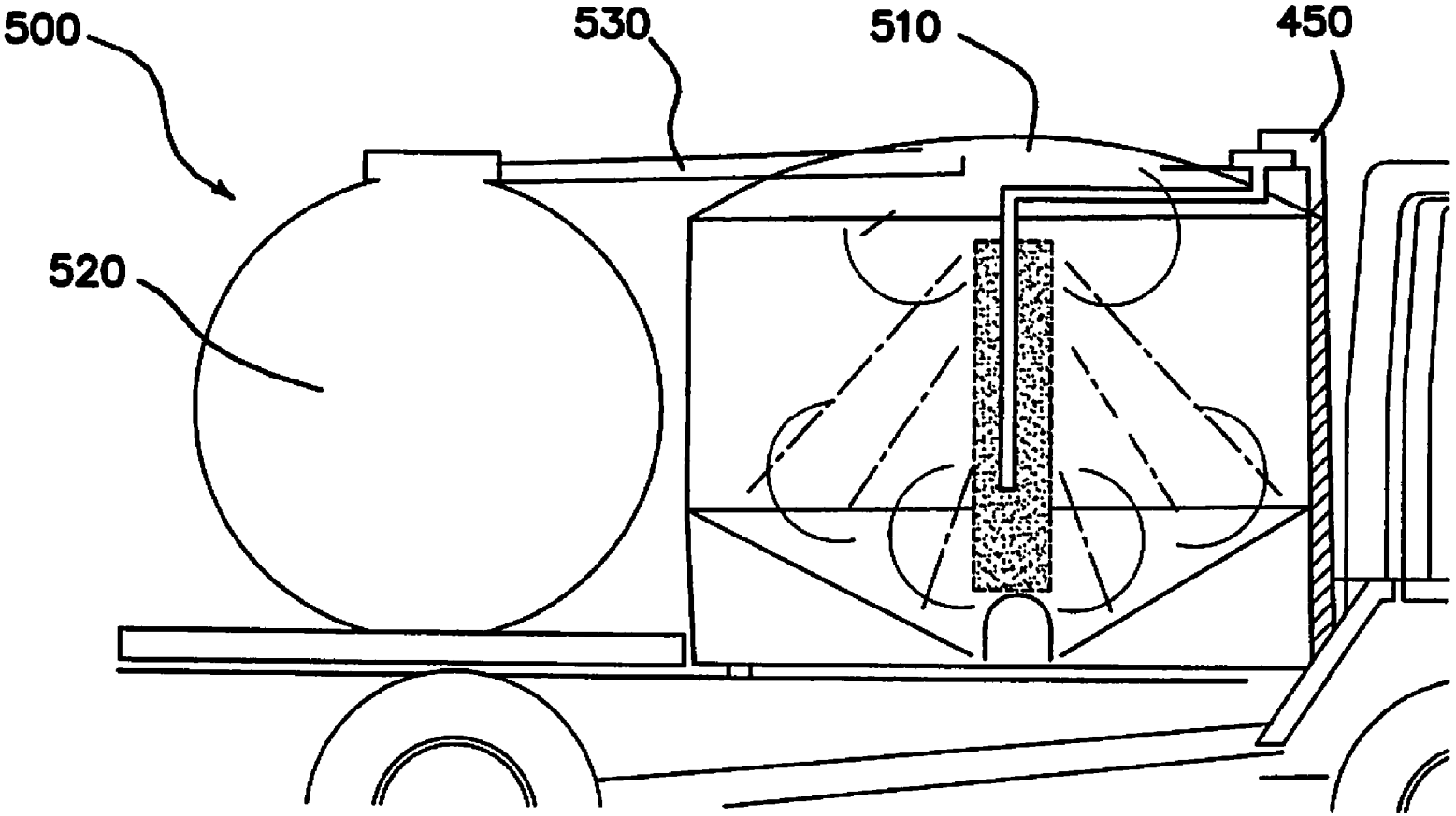
FIG. 14 illustrates a side view of a storage system of one embodiment of the present invention.

Reference is now made to FIG. 14 illustrating a storage system 500 for storing and separating debris and water similar to the liquid and debris storage container 110. The storage system 500 includes a clarifier tank 510 and a water tank 520. Like above, the tanks 510, 520 initially contain substantially clean water. During operation, the clarifier tank 510 is configured to capture and retain contaminated water and debris while the water tank 520 continues to provide substantially clean water for cleaning flat concrete and/or asphalt surfaces.

The clarifier tank 510 includes a clarifier for separating any kind of debris or waste thereby rendering the water substantially clean. When the collected debris and water exits the debris conduit 450 into the storage system 500, the trash and heavy dirt enter the clarifier tank 510 and settle near the bottom of the tank 510. In one instance, the clarifier includes a circular mesh screen that screens out and separates large particles, and allows clean water to flow to the top of the clarifier tank 510. Alternatively, industrial clarifiers including compact, vertical and circular clarifiers may be utilized. The clarifiers separate debris from water and provides for easy removal and reclamation of water. Optional equipment including drag conveyor, surface skimmer, and vapor cover may also be used as required.

The clarifier tank 510 may also contain a flocculent or other clean out systems to trap any additional debris and particulates. By separating debris and heavy particles from the water, relatively clean water flows to the top of the clarifier tank 510 and can be delivered to the water tank 520 via a transfer tube 530. The water can also be pumped from the clarifier tank 510 to the water tank 520 by an external pump (not shown). The water tank 520 has relatively clean water in it and can subsequently recycle the water to the water pump (not shown) for delivery to the spray nozzles 480 and the brushless collection ring apparatus 400. To facilitate the transfer of water from tank 510 to tank 520, the storage system 500 can incorporate additional valves and/or pumps (not shown). Furthermore, filters, vents, augers and accessible openings (not shown) as described above may be incorporated into the storage system 500. Although the water within the water tank 520 is relatively clean, the water tank 520 can further contain a flocculent or other clean out systems for trapping debris and particulates near the bottom of the tank 520 thereby allowing relatively clean water to be reclaimed and reused by the spray nozzles 480.

It will be appreciated by those skilled in the art that the brushless collection ring apparatus 400 can be configured at the front or at the back of a vehicle. Likewise, the apparatus 400 can be configured between the front and rear wheels. Furthermore, multiple apparatuses 400 offset from each other can be configured on a single vehicle. For example, a first brushless collection ring apparatus 400 can be configured at the front of the front right tire while a second brushless collection ring apparatus 400 can be configured at the back of the rear left tire. In addition, a third brushless collection ring apparatus 400 may be configured in the center of the vehicle in between the front set and rear set of tires.

Although the invention has been described in detail with reference to several embodiments, additional variations and modifications exist within the scope and spirit of the invention as described and defined in the following claims.

We claim:

1. A surface cleaning system mounted on a vehicle comprising:

a debris separation container;

a water container;

a collection apparatus defining a housing containing a series of rotatable brushes;

a debris conduit extending substantially from the collection apparatus to the debris separation container; and a water pump operable to draw water from the water container and discharge the water through one or more spray nozzles adjacent to, and directed into, the collection apparatus wherein the discharged water forces debris and water into the collection apparatus wherein said rotatable brushes act on said water and debris to move the water and debris from said collection apparatus to said debris conduit, said brushes positioned above a ground surface so that said brushes do not contact the ground surface, said one or more spray nozzles directed forward relative to movement of the vehicle during a cleaning procedure.

2. The system of claim 1, further comprising a collection tray, having an opening, positioned within the collection apparatus and extending to an opening of the debris conduit.

3. The system of claim 2, further comprising a trash pump positioned within the debris conduit.

4. The system of claim 1, further comprising one or more spray nozzles and/or air spray nozzles positioned along a length of the debris conduit.

5. The system of claim 1, further comprising a mesh screen positioned within the debris separation container.

6. A surface cleaning system mounted on a vehicle comprising:

a debris separation container;

a water container;

a collection area defining a housing containing a series of rotatable brushes;

a debris conduit extending substantially from the collection area to the debris separation container;

a water pump operable to draw water from the water container and discharge the water through one or more spray nozzles adjacent to, and directed into, the collection area wherein the discharged water forces debris and water into the collection area wherein rotatable brushes act on said water and debris to move the water and debris from said collection area to said debris conduit, said brushes positioned above a ground surface so that said brushes do not contact the ground surface;

a collection tray positioned within the collection area and extending to an opening of the debris conduit; and a trash pump positioned adjacent or within the debris conduit for forcing debris and water from the collection area into the debris conduit.

7. The system of claim 6, further comprising one or more spray nozzles and/or air spray nozzles positioned along a length of the debris conduit.

8. The system of claim 6, wherein said debris separation container has a mesh screen positioned within the storage system for separating debris from water.

9. A method of cleaning a surface comprising:

projecting water against said surface such that debris is directed into a collection area;

forcing debris and water from the collection area utilizing a series of rotatable brushes contained with said collection area to a debris conduit, said rotatable brushes positioned above a ground surface such that said brushed do not contact the ground; and moving debris and water utilizing the debris conduit into a debris separation container.

10. The method of claim 9, further comprising separating debris from water using a mesh screen within said debris separation container.

11. The method of claim 9, further comprising forcing debris and water through the collection area and into the debris conduit using pressurized streams of air, water or a combination thereof.

12. The method of claim 9, further comprising forcing debris and water through the debris conduct and into the debris separation container using pressurized streams of air, water or a combination thereof.

* * * * *